United States Patent [19]

Reiner et al.

[11] 3,951,408

[45] Apr. 20, 1976

[54] PENDULUM BOWLING GAME

[76] Inventors: Lawrence L. Reiner, 1 Hickory Lane, Woodbury, L. I., N.Y. 11797; William A. Brady, 243 Teaneck Road, Ridgefield Park, N.J. 07660

[22] Filed: July 25, 1974

[21] Appl. No.: 491,878

[52] U.S. Cl. ..... 273/38; 273/129 F

[51] Int. Cl.[2] ..... A63D 3/02

[58] Field of Search ..... 273/37, 38, 39, 51, 273/119 R, 119 A, 121 R, 121 A, 122 R, 122 A, 129

[56] References Cited

UNITED STATES PATENTS

| | | | |
|---|---|---|---|
| 448,120 | 3/1891 | Burroughes | 273/38 |
| 1,329,952 | 2/1920 | Bond | 273/38 |
| 2,061,668 | 11/1936 | Nelson | 273/149 R |
| 2,455,978 | 12/1948 | Colaluca | 273/129 |
| 3,178,184 | 4/1965 | Glassman | 273/37 X |

FOREIGN PATENTS OR APPLICATIONS

| | | | |
|---|---|---|---|
| 874,086 | 4/1942 | France | 273/39 |
| 1,906,870 | 9/1970 | Germany | 273/38 |
| 1,210,231 | 10/1970 | United Kingdom | 273/119 A |
| 173,102 | 2/1935 | Switzerland | 273/51 |

*Primary Examiner*—Anton O. Oechsle
*Attorney, Agent, or Firm*—Lackenbach, Lilling & Siegel

[57] ABSTRACT

A game requiring skill and embodying a curved alley or track and a positionable pendulum shooter having a free-swinging, but rigid, pendulum arm for striking a ball with a velocity and impact sufficient to achieve a particular ball path down the curved alley. The game is set up as a bowling game, although it may also be set up to play other games of skill.

20 Claims, 8 Drawing Figures

16
18
20
26
27
28
30
31
32
34
36

96
92
88
54
62
64
66
18
60
90
94
56
86
52
40
42
46
7
7
13
34
34
88
92
96

PENDULUM BOWLING GAME

BACKGROUND OF THE INVENTION

This invention relates to games and, in particular, to a bowling game wherein a ball is propelled onto a game board in the form of an alley having an arcuate surface by means of a rigid pivoted impact-transfer device in the form of a swingable pendulum striker.

There are numerous games of skill presently on the market for playing various types of games, such as pool, poker, bingo, anagrams, etc. For example, a tick-tack-toe game is described in U.S. Pat. No. 3,770,273 to Lawrence L. Reiner, a co-inventor of the present patent application. However, in all of such games the impact-transfer device is in the form of a fixed or directional tethered striker ball. Moreover, the playing surfaces or game boards of such games are invariably flat and usually do not add any new dimension or variation to the action or skill in playing the games. Another portable or indoor game embodying a stationary but swingably tethered mounted projecting ball is disclosed in U.S. Pat. No. 3,794,324 which pertains to skee-ball and the playing balls are propelled along an inclined alley toward scoring troughs. In this patent, a ramp near the far end of the alley is curved upwards so as to catapult or project the balls up and backwards into one of several concentric scoring troughs so as to add a dimension of play to the game and enhance the play value thereof by lending greater interest and excitement to the game.

Other well-known games conventionally employ adjustable spring loaded shooters wherein a biased plunger is pivotally aligned along a base line in a desired direction and is released to strike a ball for hitting an object, pocketing the ball or for scoring a hit or any other number of purposes. All of these games still do not provide a sufficient realism to the games nor lend thenselves to simulating or creating the real life size game.

SUMMARY OF THE INVENTION

It is, therefore, a principal object of the present invention to provide a game employing a movable, rigid pendulum shooter or striker, and a game board having a curved concave alley or track, and wherein a launched ball may be controlled to an extent so as to simulate a "curve" ball thrown down a conventional real life bowling alley.

It is another object of the present invention to provide a game construction having the advantageous characteristics mentioned in the preceding paragraph, which is extremely simple, so as to be capable of economic manufacture by mass production techniques and one which is extremely durable.

Yet a further object of the invention is to provide a portable game having a game board which is capable of being securely mounted on a table or desk or any other suitable surface.

These and other objects of the present invention will become apparent and will be more fully understood upon reading the following specification and referring to the accompanying drawings, which form a material part of this disclosure.

The invention, accordingly, consists in the features of construction, combination of elements, and arrangment of parts which will be exemplified in the construction hereinafter described, and, of which the scope will be indicated by the appended claims.

DESCRIPTION OF THE PREFERRED EMBODIMENTS

Figure 1:
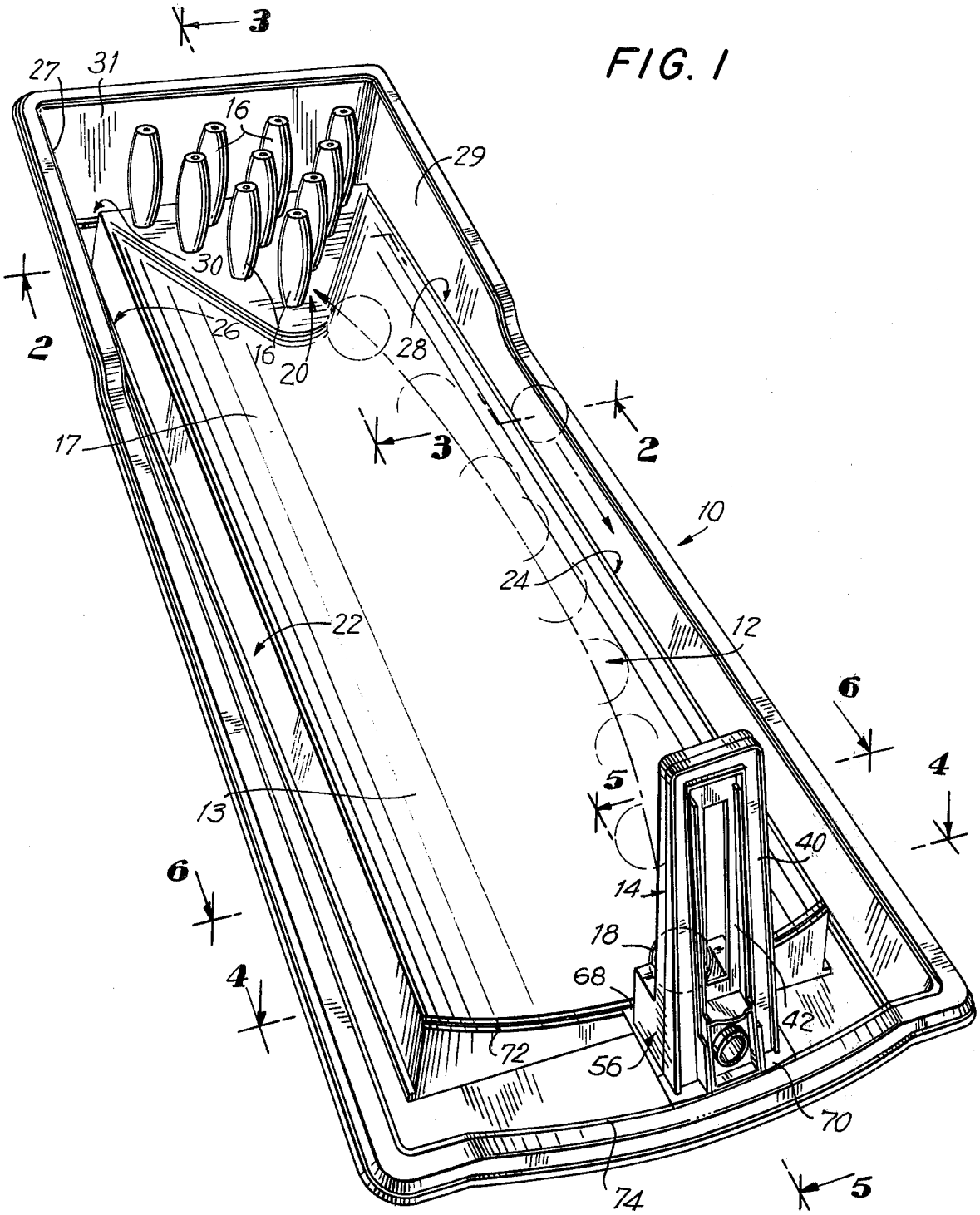
FIG. 1 is a perspective view, showing a game construction of the present invention with phantom lines illustrating a particular impacted ball and its ball path down the playing surface, and another ball in phantom shown returning via a ball return path.
Figures 2, 3:
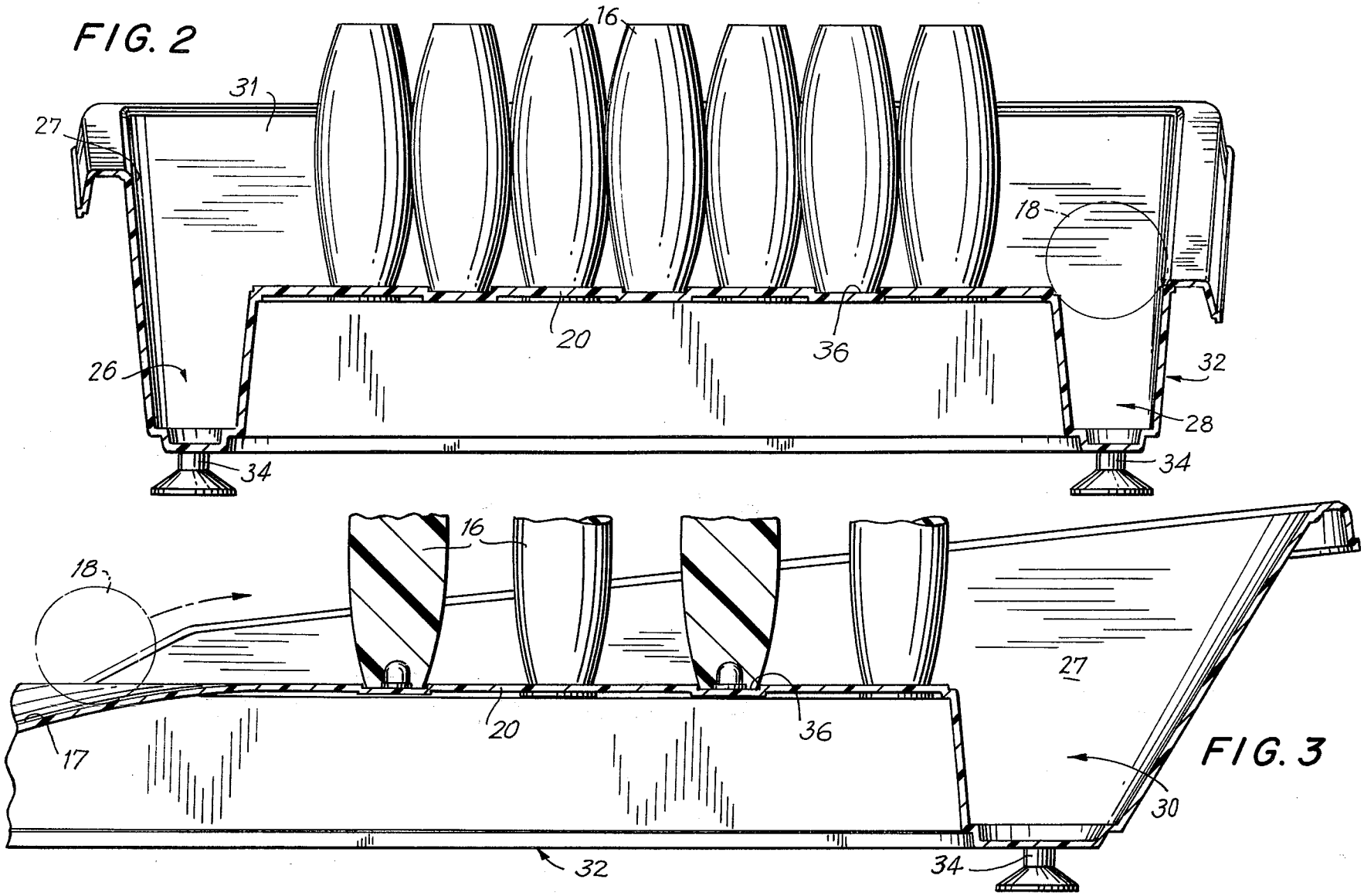
FIG. 2 is an enlarged sectional view, taken along the line 2—2 of FIG. 1.
FIG. 3 is a fragmentary sectional view, on an enlarged scale, taken substantially along the line 3—3 of FIG. 1.

Referring now to the drawings and more particularly to FIGS. 1–3, the pendulum bowling game of the present invention is generally illustrated by the reference numeral 10. The game comprises a playing surface in the form of an alley or track 12 generally of rectangular shape, a launching device or pendulum shooter 14, a set of ten pins 16 and a generally smooth, rigid sphere or ball 18. The ten pins 16 may be of any conventional shape, or may be of the barrel-shape shown in the drawings, and same are placed in four rows having a triangular or pyramid shape. A suitable plastic, such as a high-impact styrene may be used in the manufacture of said pins; but the pins may be made of other generally rigid, non-elastomeric materials, such as natural wood, synthetic wood, non-elastomeric polyurethanes or the like, or generally even other synthetic polymeric materials having said characteristics.

Figures 6, 7, 8:
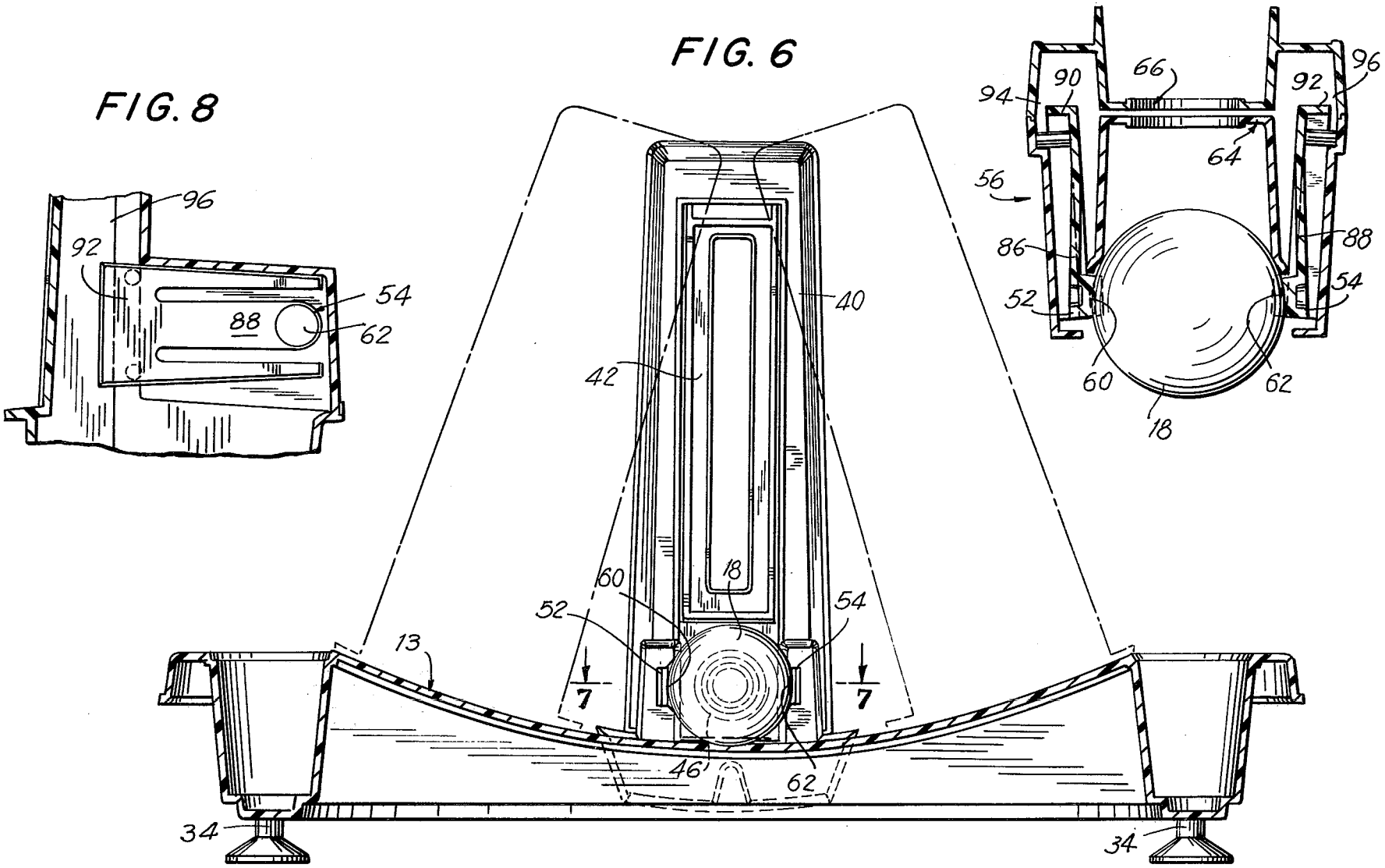
FIG. 6 is an enlarged sectional view, taken along the line 6—6 of FIG. 1.
FIG. 7 is a sectional view, taken along the line 7—7 of FIG. 6.
FIG. 8 is a sectional view, taken along the line 8—8 of FIG. 4.

The track or alley 12 is preferably curved at the front end 13 thereof as well as along a substantial portion of its length, as best shown in FIGS. 1 and 6. However, the rear portion or zone of the track 12, i.e., the triangular area 20 of the track 12 beneath the pins 16 suitably straight and flat. The curved front portion of the track blends smoothly together with the flat rear area 20 at a transition area 17, generally that portion immediately in front of the ten pins 16 forming a continuous ramp-like zone connecting the front and rear portions of the track. In FIG. 1, the flight path of a ball 18 is shown in phantom and it is illustrative of a ball following a curved path down the alley 12 and is set to ram the pins 16 in the right "strike" pocket, between lead pin No. 1 and pin No. 3.

Disposed about at least the longitudinal sides of the track or alley 12 are suitable gutter means 22 and 24 on both sides thereof for the controlled return of bowling balls along the gutters from the rear of the track to the base line or front thereof. Of course, the rear portions 26, 28 of the gutter means 22 and 24, respectively, as well as the connecting rear gutter means 30 form a three-sided trough for the reception and storing of pins 16 knocked down and out of play during operation of the game.

In the illustrated embodiment of the present invention, the gutter means 22, 24 are of a width sufficient to permit the ball 18 to roll therein supported by the longitudinal side edges thereof, as shown in FIG. 2. With a wider gutter, the ball may be caused to roll along its bottom to the front end of the alley. In this regard, although the bowling game need not have gutter means, it is desirable to provide a three-sided wall portion about the triangular area 20 supporting the pins 16. As shown therein, the outer side walls of the gutter means 26, 28 and 30 extend respectively upwardly as at 27, 29 and 31 and these walls deflect the pins 16 in a manner analogous to the deflections of pins in a conventional life-size bowling alley. If desired, a top pin deflector (not shown) may be provided over the rear gutter 30, bridging the alley 12 from one side to the other side of the outer side walls. Such a pin deflector may be permanently or removably affixed to the rear walls of the track by any number of ways, all well known in the art.

The track 12 and gutter means 22, 24 and 30 are suitably formed together as an integral base 32 for the game, and same may be fabricated from a suitable material, such as plastic, metal, wood or the like. The base 32 may be provided with legs or feet 34. Such feet should be generally of the non-scratching type, such as rubber plugs or the like, or they may also even be of the non-skid type, such as the suction-cup type shown in the drawings. These feet clearly maintain and hold the base of the game in place when it is positioned on a suitable substrate, such as a table, desk, floor, etc. (not shown). The feet 34 may be affixed to the base 32 by any suitable means, such as by fasteners, adhesives, or by inserting one end of a leg with a slightly "beaded" head into a small hole or recess in the base which locks the beaded head of the leg in place.

As best shown in FIGS. 2 and 3, the pins 16 are positioned in place in suitable depressions or spot recesses 36 forming the 10-pin set-up. These recesses 36 may be suitably marked by labels, paint or other conventional means. Although, not necessary, the recesses 36 accurately locate and stabilize the pins 16 in their proper location for playing the pendulum bowling game of the present invention. Of course, a player could estimate the position and relationship of the pins 16 with respect to each other and still play the game, but such procedure would be time-consuming and not efficient. In addition, without the spot recesses, the pins could shift slightly from their set positions, or they may even conceivably tip over if the base was bumped or otherwise disturbed.

It should also be appreciated that the alley 12 may be provided with suitable spotting markers (not shown) similar to those of a regular size bowling alley for aiding the bowler in directing the ball along a predetermined path. Also, the alley 12 may be suitably textured to provide sufficient frictional resistance between the ball and the alley and to facilitate preventing slippage of the ball on the alley. If desired, the alley may have a simulated grain surface (not shown) analogous to the track surface of a conventional bowling alley.

Figure 4:
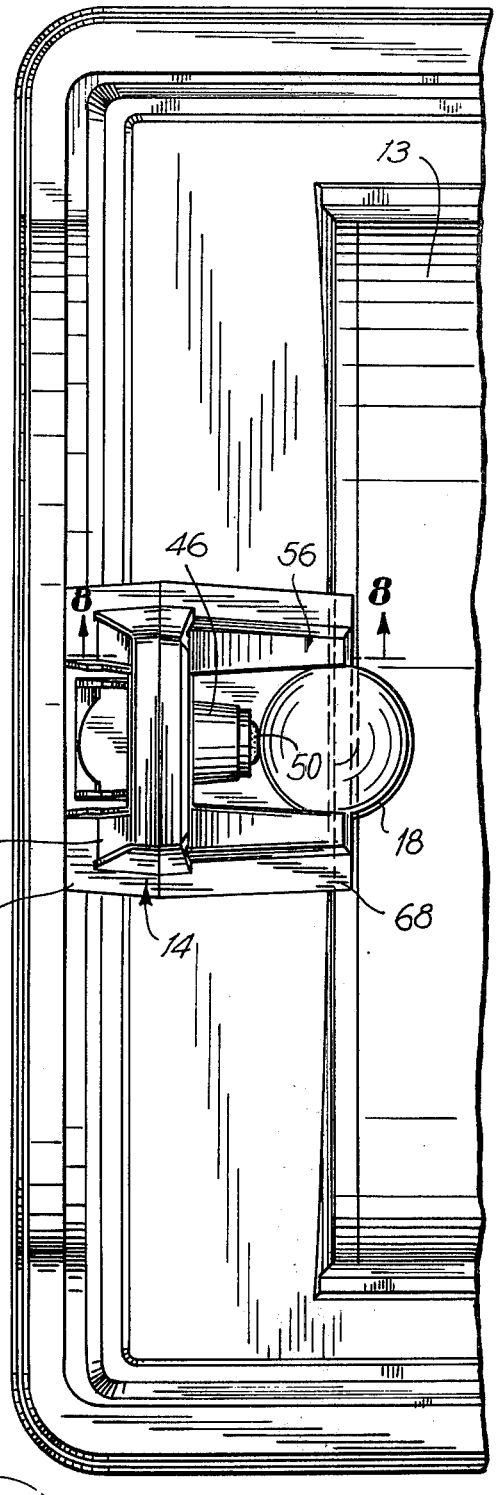
FIG. 4 is an enlarged fragmentary plan view of the impact-transfer device or ball launching mechanism and the front portion of the game board or playing surface including the base line of the alley.
Figure 5:
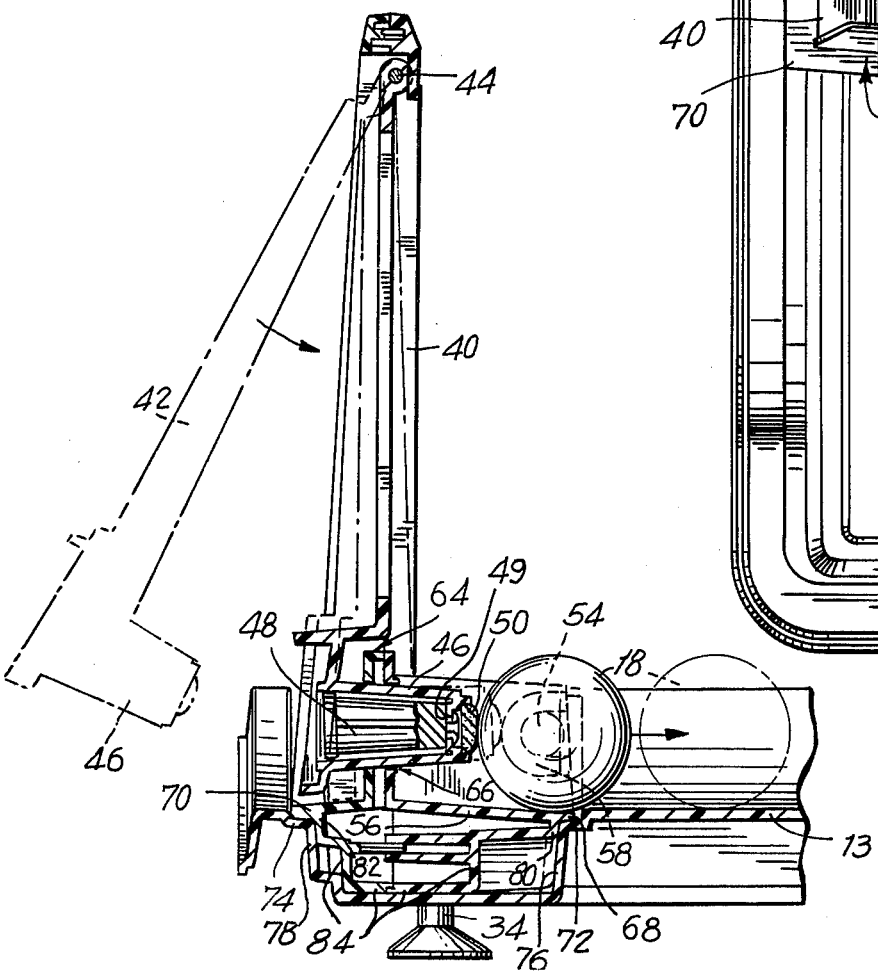
FIG. 5 is an enlarged fragmentary sectional view, taken substantially along the line 5—5 of FIG. 1.

The impact-transfer device or pendulum shooter 14, which is more particularly illustrated in FIGS. 4 and 5, is movably mounted for lateral adjustment along the curved track or alley 12, as shown in FIG. 6 by the phantom lines. The frame 40 of the pendulum 14 is suitably made from a plastic material, and supports a ball launcher or striker 42 which is pivotably secured near the upper portion of the frame 40 about a shaft, pin or other suitable pivot means 44. At the bottom portion of the striker 42 is a suitably weighted impact-transfer device in the form of a hammer 46 having a relatively heavy, metallic weight. The weight 48 is suitably fixedly disposed in place by deforming one end about a suitable aperture 49 interiorly of the hollow rear portion thereof. A tip portion 50 is also secured in a conventional manner such as by adhesives, to the front portion of the hammer 46 and extends outwardly for making contact with the ball 18. Although not essential to the operation of the game, it is preferred where a tip portion is utilized that it comprise a relatively dense, compositional material, such as presswood. In a way, such tip portion may be compared to a cue tip which is somewhat different in that it is usually chalked frequently to provide a non-slip surface for contacting the cue ball.

In the present application, the ball 18 is fixedly held between a pair of ball detent figures or buttons 52, 54 facing each other and being suitably biased by conventional means in an inwardly extending direction so as to hold a ball 18 securely therebetween. The housing 56 forming the bottom portion of the frame 40 supports the button fingers 52, 54 and is provided with U-shaped cutout portions 56, 58, respectively, for clearing the ball's spherical surface both during initial flight and when a ball 18 is seated on the floor of the housing 56 and held in place by the button fingers 52, 54. Also, the button fingers 52, 54 are further provided with concave surfaces 60, 62, respectively, generally conforming to the curvature of the ball 18, and said surfaces 60, 62 enable the quick and easy setting of the balls in position for shooting or striking during game play.

It is also within the scope of the invention in lieu of the biased button fingers, to simply employ a small circular recess or depression in the floor of the housing 56 for holding the ball 18 in place for shooting. In a like manner, the hammer 46 may comprise a rod-like element extending outwardly perpendicular to the front bottom portion of the striker 42. Moreover, the striker may comprise a single bar or channel-like element pivoted at its top end and having a solid, metal hammer, for example of cylindrical shape, secured at its other end for striking the ball.

As shown in FIG. 5, the housing 56 forms part of the frame 40 and includes a limit stop in the form of a wall 64 for stopping the swinging movement of the pendulum 14 after the ball 18 has been struck. The limit stop may, of course, be any fixed element extending in the path of the pendulum 14 for stopping same in a predetermined position. A suitable aperture 66 is provided in the wall 64 for clearing passage therethrough of the hammer 46.

In order to permit the lateral or transverse positioning of the pendulum shooter 14 with respect to the elongated or rectangular track 12, co-operatively associated guide means are provided on the bottom of the housing 56 and on the front end of the curved track portion 13 as well as the upper edge of the front end of the base 32. Said means are outwardly extending curved flanges 68, 70 on the housing 56 and co-operating curved ledge or shoulder means 72, 74, respectively, on the front edge of the curved track portion 13 and on the front wall portion of the base 32. In addition, female side surfaces 76, 78 and co-operating male side surfaces 80, 82 aid in maintaining the pendulum shooter 14 in position at any position along the shooter's curved guide track surfaces which corresponds to the curved concave alley 12. In a like manner, the bottom surfaces 84 of the housing 56 further provides for stabilizing the pendulum shooter 14 during play but clear all adjacent walls.

FIGS. 7 and 8 more particularly illustrate the biased ball detent buttons 52, 54 which extend inwardly toward each other from leaf springs in the form of cantilevered elements 86, 88. The leaf spring elements 86, 88 are connected to and form a part of their respective button supports 90, 92, which are suitably fixedly disposed in place within the hollow side portions 94, 96 of the housing 56. It should also be apparent that a single leaf spring (not shown) extending over the top of the ball may be used to maintain a ball in place against the floor of the housing prior to shooting it.

In operation, the game is played in turn, a frame at a time, by any number of players in the identical manner as the real life bowling game is played. The object of the game is to achieve the highest score (maximum 300) by knocking down the most pins during a full game of 10 frames, wherein the maximum number of balls played in each frame is two (except in the 10 frame if all pins are knocked down with the first ball, two extra balls are played).

If all ten pins are knocked down with a first shot (known as a strike) in any frame, a score is achieved totaling 10 plus the number of pins knocked down with the next two balls. The maximum score for any frame, therefore, is 30, representing three strikes in a row (three consecutive frames).

If all 10 pins are knocked down with the two balls (known as a spare) thrown in any frame, a score is achieved totaling 10 plus the number of pins knocked down with a next ball.

If one fails to topple all 10 pins down with two balls, a score of the number of pins knocked down is achieved.

A score is progressively maintained for each player from frame to frame on a "regulation scoring pad,"and totaled at the end of 10 frames to see which player has the highest score.

During play of the game, a player not shooting may be positioned adjacent the rear "pin set-up"end of the alley for returning the balls down the gutters and for repositioning the pins in place in the recesses for each frame.

At each turn, a player must first position a ball between the biased finger detent buttons, and locate the pendulum shooter to any position on the curved track at the base of the alley. The pendulum shooter is then grasped with one hand, and with the other hand, a player draws back the pendulum's pivoted arm to any height position, such as a horizontal position. Release of the arm with a smooth positive downward motion of one's hand permits the hammer to strike the ball and propel it down the alley. By noting the path of the ball which due to the curved alley causes the ball to curve as it rolls down the alley, one may find the right velocity to achieve the path desired. Of course, the height of the hammer being swung and the force (harder or softer) with which one releases the arm for driving or propelling the ball down the alley all contribute to ultimately determining the momentum of the driven ball and as to when it will start to curve downwardly on the track as illustrated in phantom in the first perspective figure of the drawings. If insufficient momentum is transferred to the driven ball and it does not reach the pins, then it is considered a "gutter" ball and a player receives no pin score for such gutter ball.

From the foregoing, it is seen that the game device of the present invention provides a game which is extremely simple in construction, so as to be capable of economic manufacture and sale, while being uniquely attractive to persons of wide physical and mental range, and which otherwise fully accomplishes its intended objects of bringing a totally new dimension to table top bowling.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. A game having a game board and having a playing surface in the form of an alley of generally rectangular shape, and being adapted to receive a plurality of pins, and for providing a path for a ball propelled down said alley, comprising:

a generally concave arcuate alley surface extending from a front end edge of said alley for a substantial portion of its length, and a remaining relatively flat rear portion with a generally contoured surface portion therebetween blending said portions together;

an impact-transfer device having a pivoted pendulum striker;

means for movably mounting said impact-transfer device laterally of said alley, said means for movably mounting includes mutually cooperatively associated elements on said impact-transfer device and on said game board, said elements having mating arcuate guide track surfaces corresponding to said arcuate alley surface;

means for supporting said ball in impact-transfer relation to said impact-transfer device; and said impact-transfer device being operable to propel said ball onto said alley from a location determined by the lateral position of said impact transfer device with respect to said alley.

2. The game according to claim 1, wherein said game board includes means disposed along the longitudinal side portions of said alley for transferring a ball from the rear of said alley to the front of said alley.

3. The game according to claim 1, wherein side wall deflectors are provided spaced apart from and about the rear side and edge portions of said alley for deflecting said pins upon impact with said ball propelled down said alley.

4. The game according to claim 1, wherein the rear portion of said alley is provided with markers for receiving said plurality of pins in a predetermined relationship.

5. The game according to claim 4, wherein said plurality of pins are arranged in relatively shallow recesses disposed in a plurality of rows in said flat portion of said alley, thereby forming a pyramid with a first, single head pin closest to said front end edge of said alley.

6. The game according to claim 5, wherein said head pin forms a first row and said plurality of pins number 10, and said additional rows respectively contain two, three and four pins.

7. The game according to claim 1, wherein said striker is provided with a hammer-like portion at an end opposite to pivot means pivotably supporting said striker at its other end, and includes a weight secured to said hammer-like portion.

8. The game according to claim 7, wherein said weight is generally a heavy metal element.

9. The game according to claim 7, wherein said impact-transfer device includes a frame and said striker is pivotably mounted to the upper portion of said frame.

10. The game according to claim 1, wherein said impact-transfer device includes a lower housing portion having said means for supporting said ball.

11. The game according to claim 12, wherein said means for supporting said ball include a pair of ball grippers adapted to hold opposite sides of said ball, whereby said ball is maintained in place for striking same upon release of said pivoted pendulum striker.

12. The game according to claim 11, including biasing means for said grippers adapted to provide sufficient grip force to said grippers for holding said ball in place.

13. The game according to claim 1, wherein said elements including groove means in said game board forming said guide track surfaces and means on the bottom portion of said impact-transfer device adapted to be engageable with said groove means for movably mounting said impact-transfer device along said guide track surfaces.

14. The game according to claim 1, including a limit stop for halting the swinging motion of said impact-transfer device.

15. A game comprising a game board including a simulated bowling alley being generally concavely curved in transverse cross section and having proximate and remote ends, an object-supporting section at the remote end of said bowling alley adapted to support a plurality of pins thereon, impact-transfer means having a pivoted pendulum striker at the proximate end of said bowling alley adapted to launch a playing bal along said alley toward said object-supporting sectior and means mounting said impact-transfer means foı adjustment to various transverse locations at said proximate end for launching said ball along said alley; said means mounting said impact-transfer means including mutually co-operatively associated elements on said impact-transfer means and on said game board, said elements having mating arcuate guide track surfaces corresponding to said concavely curved alley; means for supporting said ball in impact-transfer relation to said impact-transfer means; and said impact-transfer means being operable to propel said ball onto said alley from a location determined by the lateral position of said impact-transfer means with respect to said alley.

16. The invention according to claim 15, said object-supporting section being generally plane and said alley including a transition section adjacent said object-supporting section constructed and arranged for establishing a continuous surface between said curved cross section of said alley and said object-supporting section.

17. The invention according to claim 15, wherein said impact transfer means includes a striker and means pivotably mounting said striker thereon for launching said playing ball along said alley.

18. The invention according to claim 17, wherein said striker mounting means is rigid and said striker travels in a predetermined arcuate path to launch said playing ball along said alley.

19. The game according to claim 15, wherein said concave alley surface is substantially uniformly concavely curved in transverse cross-section along its length for a substantial portion thereof.

20. The game according to claim 15, wherein said bowling alley is substantially uniformly concavely curved in transverse cross-section from said proximate end of said bowling alley to said object-supporting section.

* * * * *